US008800793B2

(12) United States Patent
Pfenniger et al.

(10) Patent No.: US 8,800,793 B2
(45) Date of Patent: Aug. 12, 2014

(54) TEAT UNIT

(71) Applicant: Medela Holding AG, Baar (CH)

(72) Inventors: Erich Pfenniger, Ebikon (CH); Peter Vischer, Küssnacht am Rigi (CH); Mario Rigert, Buchrain (CH); Alex Stutz, Baar (CH)

(73) Assignee: Medela Holding AG, Baar (CH)

( * ) Notice: Subject to any disclaimer, the term of this patent is extended or adjusted under 35 U.S.C. 154(b) by 0 days.

(21) Appl. No.: 13/738,975

(22) Filed: Jan. 10, 2013

(65) Prior Publication Data

US 2013/0119008 A1 May 16, 2013

Related U.S. Application Data

(63) Continuation of application No. 12/482,300, filed on Jun. 10, 2009, now Pat. No. 8,371,462.

(30) Foreign Application Priority Data

Jun. 12, 2008 (CH) ..... 00897/08

(51) Int. Cl.
*A61J 11/02* (2006.01)
*A61J 11/04* (2006.01)

(52) U.S. Cl.
CPC .. *A61J 11/02* (2013.01); *A61J 11/04* (2013.01)
USPC ..... 215/11.5; 215/11.1; 215/11.4

(58) Field of Classification Search
CPC ..... A61J 9/00; A61J 11/02; A61J 11/04
USPC ..... 215/11.2, 11.4, 11.5, 11.1; 220/711, 220/714
See application file for complete search history.

(56) References Cited

U.S. PATENT DOCUMENTS

| | | | | | |
|---|---|---|---|---|---|
| 1,937,278 | A | * | 11/1933 | Kleine | 215/11.5 |
| 2,760,665 | A | | 8/1956 | Zenker | |
| 2,987,209 | A | * | 6/1961 | Royal | 215/11.3 |
| 3,266,910 | A | | 8/1966 | Barnby | |
| 3,468,445 | A | | 9/1969 | Ballin | |
| 3,549,036 | A | * | 12/1970 | Ritsi | 215/11.6 |
| 4,548,157 | A | | 10/1985 | Hevoyan | |
| 4,620,638 | A | | 11/1986 | Schmidt | |
| 4,801,007 | A | | 1/1989 | Rule | |
| 4,801,027 | A | | 1/1989 | Hunter | |
| 4,867,324 | A | | 9/1989 | Rogosich et al. | |
| 5,295,597 | A | * | 3/1994 | Green | 215/11.4 |

(Continued)

FOREIGN PATENT DOCUMENTS

| | | | |
|---|---|---|---|
| DE | 20119917 | U1 | 11/2002 |
| DE | 202004013018 | U1 | 11/2004 |
| WO | 2007053894 | A1 | 5/2007 |

OTHER PUBLICATIONS

Swiss Search Report dated Nov. 19, 2008.

*Primary Examiner* — Sue A Weaver
(74) *Attorney, Agent, or Firm* — McDonnell Boehnen Hulbert & Berghoff LLP

(57) ABSTRACT

A teat unit has a flexible teat, a receiving head and a dimensionally stable base part. The teat is arranged on the receiving head. The receiving head and the base part are connected to each other by a releasable plug connection, and the receiving head has a securing element for securing the teat unit on a drinks container.

25 Claims, 12 Drawing Sheets

(56) References Cited

U.S. PATENT DOCUMENTS

| | | | | |
|---|---|---|---|---|
| 5,478,325 | A | 12/1995 | Fu-Hsiang | |
| 5,758,786 | A | 6/1998 | John | |
| 6,045,254 | A | 4/2000 | Inbar et al. | |
| 6,112,919 | A | 9/2000 | Ho | |
| 6,161,710 | A * | 12/2000 | Dieringer et al. | 215/11.4 |
| 6,354,449 | B1 | 3/2002 | Smith | |
| 6,499,615 | B1 * | 12/2002 | Szieff et al. | 215/11.5 |
| 6,851,565 | B2 | 2/2005 | Stephan | |
| 7,044,316 | B1 * | 5/2006 | Hsu | 215/11.1 |
| 7,210,591 | B2 * | 5/2007 | Goldman et | 215/11.1 |
| 7,556,172 | B2 * | 7/2009 | Lane | 220/714 |
| 7,975,861 | B2 | 7/2011 | Rieppel | |
| 2002/0063103 | A1 * | 5/2002 | Kiernan | 215/11.4 |
| 2002/0162816 | A1 | 11/2002 | Walsh | |
| 2003/0085193 | A1 | 5/2003 | Hsu | |
| 2006/0129127 | A1 * | 6/2006 | Ruth et al. | 604/514 |
| 2006/0237387 | A1 | 10/2006 | Pyun | |
| 2009/0071926 | A1 * | 3/2009 | Berkovitch et al. | 215/11.4 |
| 2009/0139950 | A1 * | 6/2009 | Greter et al. | 215/11.5 |

* cited by examiner

TEAT UNIT

CROSS-REFERENCE TO RELATED APPLICATIONS

This application is a continuation of U.S. patent application Ser. No. 12/482,300, filed Jun. 10, 2009, now U.S. Pat. No. 8,371,462, issued Feb. 12, 2013, entitled "Teat Unit", which claims priority to Swiss Patent Application No. 00897/08, filed Jun. 12, 2008, the contents of which are fully incorporated by reference.

BACKGROUND OF THE INVENTION

The invention relates to a teat unit.

The best known teat unit for a baby's feeding bottle has a ring with an inner thread, and a teat extending through this ring. The teat has a substantially frustoconical main body which, at the narrower end, merges into a substantially cylindrical mouthpiece. Formed integrally on the broader end of the main body there is a flange which, by virtue of the threaded ring, bears sealingly on the neck of the bottle. This unit is inexpensive, easy to clean and easy to handle, but it is greatly limited in terms of its possible variations and as a result is unable in particular to meet the requirements of premature babies or infants who have difficulties drinking.

In U.S. Pat. No. 5,553,726, a valve is inserted in the transition area between mouthpiece and main body.

WO 2007/053894 discloses a three-part teat unit for a baby's bottle. Here too, a threaded ring and a teat are provided. The third part is a plate, which is fitted onto the neck of the bottle. The teat is arranged above the plate, and both parts are held in their position by the threaded ring. The plate has openings which, depending on the position of rotation of the threaded ring, form a passage to the teat or are closed by the threaded ring.

In U.S. Pat. No. 5,791,503, a similar arrangement is used to allow air into the bottle during the pauses when the baby is not sucking.

US 2004/0035815 describes a drinking cup with teat for young children. The teat and a valve element are held in a lid of the cup by means of a threaded ring, said threaded ring pressing from outside onto a flange of the teat, and the flange bearing with its inner surface on the valve element. The valve element in turn sits on a shoulder of the lid.

US 2005/0224444, U.S. Pat. No. 2,584,359, EP 0 384 394 and EP 1 416 900 also disclose teats that extend through a threaded ring and are held sealingly by the latter on a baby's bottle. The third part is in each case a valve body, which bears with a flange on the neck of the bottle, extends into the interior of the teat and is likewise held in its sealing position by the threaded ring.

A teat unit with a complex construction is disclosed in WO 97/04735, the teat in this case too being held on the bottle by a one-piece threaded ring.

WO 2007/137440 discloses a teat unit with a one-piece or two-piece teat and with a dimensionally stable receiving head for receiving the teat. The one-piece receiving head is provided with a threaded ring, such that it can be screwed onto the neck of a baby's bottle or a drinking cup. The teat is fitted on the semi-spherical receiving head and is not secured with the threaded ring.

In U.S. Pat. No. 1,605,427, the teat is fitted on the neck of the bottle directly, i.e. without an intermediate ring. The mouthpiece of the teat is strengthened by an insert part. In BE 381 523 also, the teat is fitted directly on the neck of the bottle.

U.S. Pat. No. 7,225,938 discloses a teat unit in which an intermediate chamber with a valve is screwed onto the baby's bottle. The known threaded ring, with the teat extending through it, is then screwed onto this intermediate chamber.

WO 99/22693 discloses a teat unit with a threaded ring and a two-piece suction body extending through the latter. The threaded ring is screwed with its inner thread onto an adapter part which has an inner thread and outer thread and which is secured with its inner thread on a neck of a baby's bottle.

Although these known solutions in each case optimize one of the following five functions, they at the same time detract from at least one of the other four functions;

- optimal milk flow,
- reliable closing and opening at a specific predetermined pressure, in the case where a valve is used,
- optimal venting during the pauses when the baby is not sucking,
- simple securing of the teat, and simple removing of same from the rest of the teat unit and from the bottle, and simple cleaning, and
- optimal interface with the baby's mouth by virtue of the suitable elasticity of the teat unit.

The known solutions also have one or more of the following disadvantages:

- they are of a complicated structure and are therefore expensive to produce,
- the teat has to be designed with a relatively thick wall, which in turn makes production more difficult and increases costs, and
- they can be used only in a single configuration and do not permit any variations.

SUMMARY OF THE INVENTION

It is therefore an object of the invention to make available an improved teat unit. In a preferred embodiment, the teat unit allows for greater flexibility in terms of its configuration and thus allows the abovementioned five functions to be variously optimized.

In a preferred embodiment, the teat unit has a flexible teat, a receiving head, a dimensionally stable base part, and a venting valve. The teat is arranged on the receiving head and the receiving head and the base part are connected to each other by a releasable connection. The venting valve is arranged in the base part. The venting valve may be held by the base part, and may be arranged in an inner truncated cone located in the base part.

In one example embodiment, the inner truncated cone comprises rectilinear flanks. In another example embodiment, the inner truncated cone comprises curved flanks.

In one example embodiment, the base part comprises an annular body and the inner truncated cone may extend to the receiving head. The base part may comprise a circumferential sealing edge and the inner truncated cone may be arranged within the circumferential sealing edge.

A through-opening may be arranged in an uppermost area of the truncated cone.

In another example embodiment, the receiving head may comprise an outer truncated cone. The outer truncated cone may comprise a flattened tip and a through-opening may be arranged in the flattened tip. The outer truncated cone may surround the inner truncated cone, and a gap may be formed between the inner truncated cone and the outer truncated cone, wherein the gap forms a vent chamber and wherein the venting valve communicates with the vent chamber. The outer truncated cone may have a first inclination and the inner truncated cone may have a second inclination that is different from the first inclination.

The receiving head may comprise an underside directed to the base part and the underside may comprise a sealing surface.

The releasable connection between the receiving head and the base part may be a plug connection that allows for the receiving head to be plugged into the base part. The receiving head may have at least one protruding plug element for the plug connection to the base part, wherein the securing element is arranged on the plug element or plug elements. The receiving head may be designed in one piece and be dimensionally stable.

The teat may comprise a circumferential edge that is clamped between the receiving head and the base part when fitted in the correct position of use on a drinks container. The teat may be pushed over the receiving head and the circumferential edge may engage around a circumferential edge of the receiving head and bear on a circumferential sealing surface of the receiving head. The base part may have a circumferential sealing surface that interacts with the circumferential sealing surface of the receiving head, and the teat may be clamped between the two sealing surfaces when fitted in the correct position of use on a drinks container.

The venting valve may be a duck bill valve, and may be arranged in one of the through openings. The venting valve may be arranged in the through opening of the base part and may be fixed to the base part.

The receiving head and the base part may have through openings for forming a channel between a suction opening in a mouthpiece of the flexible teat and the container.

In another preferred embodiment, the teat unit has a flexible teat, a receiving head, a dimensionally stable base part, a vent chamber, and a venting valve. The vent chamber is arranged between the base part and the receiving head and communicates with an environment of the teat unit via at least one inlet opening, as well as communicates with the vent chamber.

The teat unit according to one example embodiment has a flexible teat, a receiving head and a dimensionally stable base part. The teat is arranged on the receiving head. According to the invention, the receiving head and the base part are connected to each other by a releasable plug connection, and the receiving head has a fastener or securing element, for example a thread, for securing the teat unit on a drinks container.

With this basic concept, that is to say a modular construction obtained by dividing the teat unit into three parts, the plug connection between receiving head and base part, and the choice of the receiving head as the part producing the secure connection to the drinks container, it is possible for the teat unit to be configured extremely flexibly. A change in one area of the teat unit does not immediately necessitate a change in another area or in all areas. Thus, the various objectives and functions of the teat unit can also be separated from one another.

Differently shaped teats, preferably teats made in one piece, can be used with the receiving head and the base part. Moreover, differently shaped receiving heads can be used with the same teat and base part. The shape of the base parts can also be varied. This facilitates the development and refinement of teat units, since it is not necessary to meet new considerations in every case. The developer can instead rely on this basic concept, without in so doing being too restricted in terms of freedom of design. Moreover, basic dies, in particular basic dies of injection mould cavities, can be reused. This reduces the development and production costs for new products.

It is not only the designer and manufacturer of such parts who is able to vary the composition. It is also possible, to a certain extent, for a mother, for example, to assemble the various teats, receiving heads and base parts to form different variations. This increases the flexibility in use. She can assemble the optimal arrangement of the teat unit for her child without having to purchase a huge number of individual parts.

For example, the receiving head can have different designs. Its surface structure in particular can be designed very flexibly, such that the interaction with the teat can be optimized. The receiving head can be stiff and dimensionally stable. However, it can also comprise only a main body with a stiff material and be provided with soft areas, or with areas softer than the main body. Differently shaped supporting bodies can be used. These can be arranged peripherally, centrally or at any other suitable location. A suitable combination of supporting bodies and air gaps can be chosen. By virtue of all these possibilities, the interface with the baby's mouth, in particular the elasticity of the teat unit, can be configured very flexibly and thus optimized.

Valves and vent openings can be formed at many different points, for example between teat and receiving head, and between receiving head and base part. The through-openings for the milk can be closed by a valve diaphragm, for example. It is also possible for two or more valves to be fitted at different points. Reliable closing and opening at a specific predetermined pressure is made possible in this way.

Apart from the common plug connection, the receiving head and the base part cannot interact with each other in any way. However, they can also be configured such that they form common vent chambers or milk collection chambers, for example. By virtue of these possible variations, the flow of milk can be optimized, and optimal venting during the pauses when the baby is not sucking is ensured.

Since the teat is arranged on the receiving head, it can be easily secured in place and then removed again. Moreover, since the receiving head and the base part in preferred embodiments are only plugged into each other, all the parts are easy to clean.

A further advantage is that the teat does not have to have any thickened wall parts, or can be designed with a relatively thin wall, and is thus inexpensive to manufacture.

The receiving head is preferably plugged into the base part.

The plug connection between receiving head and base part can be arranged at a location other than on the securing element. However, the receiving head preferably has at least one protruding plug element for the plug connection to the base part, and the securing element or means, in particular the thread, is arranged on this at least one plug element. The plug element can be circular with a complete circumference. Preferably, however, several individual plug elements are uniformly distributed about the circumference of the receiving head in a manner spaced apart from one another. They form a common circle and, if a thread is used as securing element, form a common thread.

The plug elements can be made resilient and have a smaller common internal diameter than the external diameter of the container opening. In this way, they are forced outwards during fitting and press onto the base part. This increases the fixing of receiving head and base part relative to each other.

In a preferred embodiment, the base part has at least one slit into which the receiving head, in particular the plug element, can be plugged.

The plug connection is preferably designed such that it can be locked. In this way, even when not in the assembled state, the parts can be stored fitted together and do not fall apart.

The receiving head preferably has supporting bodies which are arranged peripherally and are distributed uniformly about its circumference, and which interact with the teat. The elasticity of the teat unit can in this way be easily optimized, without the teat itself needing to have excessively complicated design forms.

In a preferred embodiment, the receiving head is designed in one piece and is dimensionally stable. It is preferably made of plastic and is produced in an injection moulding operation. The production costs can be minimized in this way.

In another preferred embodiment, the receiving head has a dimensionally stable base body and attachment elements made of a softer material than the base body. The base body too can be produced inexpensively from plastic in an injection moulding operation. The softer areas can then preferably be injected on or produced in a two-component injection moulding technique. They are preferably made of silicone, rubber or a thermoplastic elastomer (TPE).

In a preferred embodiment, a circumferential edge of the teat is clamped between receiving head and base part when the unit is fitted in the correct position of use on the drinks container. It can be easily designed in this way and can be easily secured in place and removed. It is advantageous that the teat is not clamped between container and teat unit, but instead inside the teat unit itself. The clamping can be done even before the unit is mounted on the drinks container. However, it is preferably done only when the teat unit is secured on the drinks container, for example by the receiving head and base part being fixed in their relative position to each other.

The teat is preferably pushed on over the receiving head, wherein its circumferential edge engages around a circumferential securing edge of the receiving head and bears on a circumferential sealing surface of the receiving head. The base part has a circumferential sealing surface interacting with this, the teat being clamped between these two sealing surfaces when fitted in the correct position of use on the drinks container. The clamping can thus be carried out when fixing the relative position of the receiving head and of the base part to each other. This arrangement has the advantage that the teat can be fitted even after the plug connection between receiving head and base part has already been established, provided there is enough play available before it is fixed.

It is advantageous that the two functions "fixing of the teat" and "establishing of an airtight connection between teat and receiving unit" are accomplished at two different locations and therefore separately from each other. The inner skirt is responsible for the tightness, the circumferential flange for the fixation. Thereby, the implementation of standards concerning the fixed connection between the teat and the baby's feeding bottle is simplified.

If the securing element is a thread which, when the securing element is placed on the drinks container, is brought into engagement with a corresponding thread of the drinks container, then the receiving head and the base part are fixed relative to each other simply by the formation of the threaded connection. The receiving head preferably has an inner thread, and the neck of the container has an outer thread. The base part has an abutment which prevents further movement of the base part relative to the container. The abutment takes the form, for example, of an upper bearing surface of the base part, with which bearing surface the base part bears on the upper edge of the container opening.

The base part preferably has a main body in the form of a ring, which has a through-opening. This makes cleaning easier and simplifies production.

In another embodiment, a vent chamber is present between base part and receiving head, which vent chamber communicates with the environment via at least one inlet opening and is connected to the interior of the drinks container via at least one outlet opening when in the correct position of use. The venting is ensured permanently in this way. Moreover, at least one valve can be arranged in this area in order to optimize the venting.

In a preferred embodiment a lid and a closure cap are present. Thereby, base part, receiving head and teat are able to be assembled and to be closed from both sides. In this manner, this unit is able to be sold so as to be hygienically packaged. It, however, is also able to be stored in this manner so as to be hygienically sealed after each cleaning. The lid is thereby pushed over the teat and the closure cap is connected with the base part and the receiving head on the opposite side.

The teat unit according to the invention can be used with any shapes of drinks containers, as long as the opening of the container is adapted to the securing element of the teat unit. A preferred field of application is that of feeding bottles for babies or drinking cups or beakers for infants. Other fields of application are drinks containers of the kind used in nursing care, in geriatrics or in sport.

Further advantageous embodiments are set forth in the dependent patent claims.

BRIEF DESCRIPTION OF THE SEVERAL VIEWS OF THE DRAWINGS

The subject matter of the invention is explained below on the basis of preferred illustrative embodiments depicted in the attached drawings, in which the same parts are designated by the same reference numbers, and in which.

DETAILED DESCRIPTION OF THE INVENTION

Figure 1C:
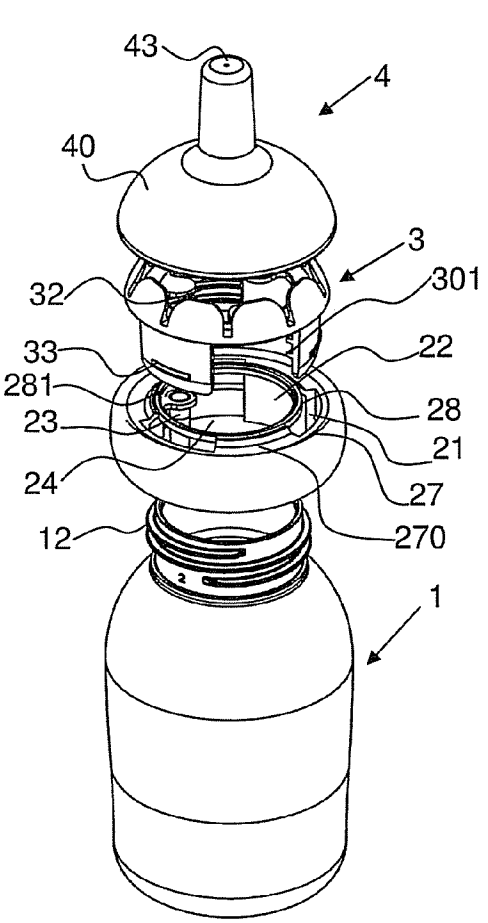
FIG. 1*c* shows a perspective view of the teat unit with breastmilk bottle according to FIG. 1*a;*
Figure 1B:
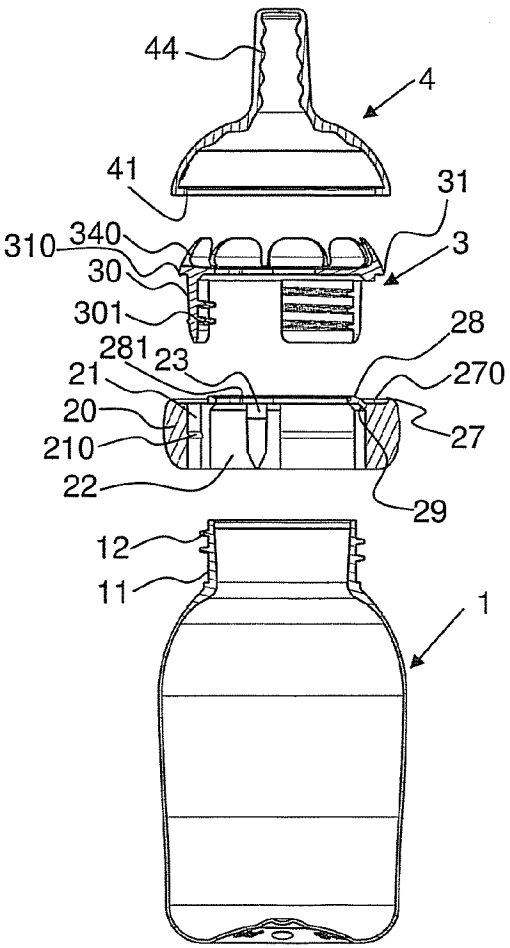
FIG. 1*b* shows a longitudinal section through the teat unit with breastmilk bottle according to FIG. 1*a;*
Figure 1A:
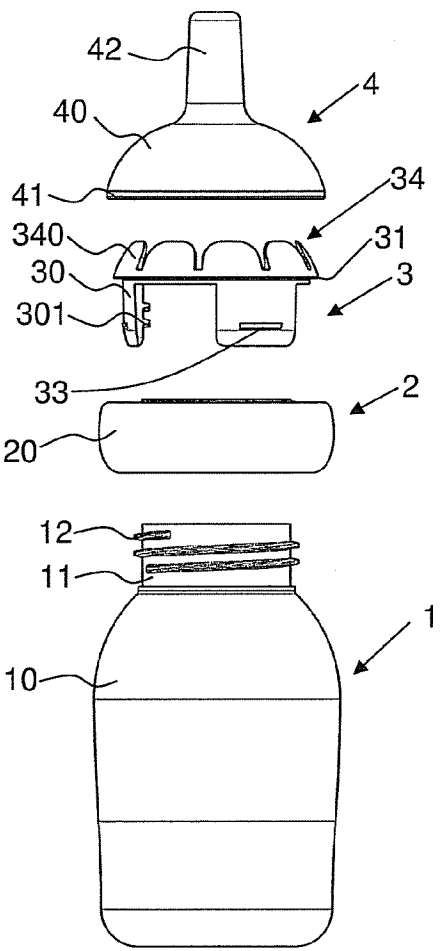
FIG. 1*a* shows an exploded side view of a teat unit according to the invention together with breastmilk bottle, according to a first embodiment.

In FIGS. 1*a* to 1*c*, a first illustrative embodiment of the teat unit 2, 3, 4 according to the invention is shown together with a breastmilk bottle 1 for a baby.

The baby's bottle 1 is shown only by way of example. Other types and shapes of drinks containers can also be used together with the teat units according to the teaching of the invention. However, they preferably have a container neck with an outer thread.

The baby's bottle has a container main body 10 for receiving the drinking liquid, said main body 10 narrowing to a neck 11 of smaller diameter. An outer thread 12 is formed integrally on the neck 11.

The teat unit according to the invention is basically composed of three parts: a base part 2, a receiving head 3 and a suction body or teat 4. The base part 2 is preferably made of polypropylene (PP) or a polyamide, the receiving head 3 is made of PP or a polyamide, or a combination of PP or a polyamide with silicone, rubber or TPE. For the teat 4, silicone, a silicone-based plastic, rubber or TPE is preferably used.

The base part 2 is dimensionally stable and is made of a stiff material. It is composed principally of an annular body 20 with a circumferential, closed outer jacket, which preferably provides sufficient grip to allow it to be used as a rotary ring when fitting the teat unit on the container 1 and when removing it from the latter.

The annular body 20 in these examples has a radial thickness that is substantially smaller than the diameter of the ring. In this example, a through-opening 24 is present at the middle and connects the interior of the container 1 to the outside.

At least one slit (or slot) 21 is arranged in the circumferential edge of the annular body 20. Here, three slits 21 are present, these being distributed uniformly about the circumference of the annular body 20 in the peripheral area thereof. The slits are curved corresponding to the radius of the annular body 20.

The slits 21 extend to the inner wall of the annular body 20, such that thickened wall areas 22 are present between them. The distance between opposite wall areas (measured through the centre point of the annular body 20) is equal to or preferably greater than the external diameter of the thread 12 of the container 1. These thickened wall areas 22 are preferably smooth on their inner face directed towards the container neck 11. In particular, they do not have a thread. The wall areas thinned by the slits 21 have a locking rib 210 at least at one point, in this case all the way round.

On the top face of the base ring 2 directed away from the container neck 11, there is a circumferential outer sealing edge 27 that protrudes upwards. This is preferably formed by the uppermost peripheral edge of the base ring 2. It is adjoined in the radially inward direction by a circumferential, plane and recessed outer sealing surface 270. The latter preferably extends approximately perpendicular to the longitudinal centre axis of the base ring 2. It preferably extends, both in a radial direction and also in a tangential direction, to the slits 21. In so doing, it also at least partially fills the area between the slits 21 in the radial direction.

Adjacent to or spaced apart from the outer sealing surface 270, there is an inner circumferential sealing edge 28, which likewise protrudes upwards. The slits 21 are thus situated between the first and second sealing edges 27, 28. In this illustrative embodiment, the inner sealing edge 28 limits the through-opening 24. This sealing edge 28 is preferably interrupted by at least one vent opening 281, which leads to the outside. The way to the outside can, for example, lead via an untight threaded connection to the breastmilk bottle 1.

A venting valve 23, here a duckbill valve, is preferably arranged in the through-opening 24. It can likewise be formed in one piece with the rest of the base part 2. However, it is preferably only its retainer that is integrally formed in a one-component or multi-component injection moulding operation, and the valve flap or valve tube is made from a film and is attached subsequently. It can, however, also be formed integrally in a two-component injection moulding operation. The venting valve 23 protrudes inwards to the container neck 11; its length corresponds at most to the width of the sealing ring 2 and does not therefore protrude down from the latter.

This base part 2 can be placed onto the container neck 11, but without it being fixed in position relative to the latter, in particular secured in terms of rotation. A lower abutment 29 is present and limits the extent to which the container neck 11 can pass through the base part 2, i.e. to what extent the base part 2 can slip down on the container neck 11. In the examples shown here, the abutment is an inner bearing surface 29 in the upper area of the base ring 2. This bearing surface 29 is formed by the connection of the inner sealing edge 28 and the thickened wall areas 22. Other kinds of abutments 29, for example protruding lugs or ribs, are also possible.

The receiving head 3 is likewise designed annularly and preferably rotationally symmetrically and has a central through-opening 32. It is composed basically of two areas. The lower area is formed by at least one plug element, in this case three plug elements 30, which form portions of a common jacket that are distributed uniformly about the circumference. On their inner face, the plug elements 30 form a common inner thread 301. At least one of the plug elements 30 has a locking rib 33 on its outer face. Instead of an inner thread, it is also possible for an outer thread to be present if the drinks container 1 is provided with a corresponding inner thread.

The receiving head 3 can be plugged into the base part 2, the plug elements 30 engaging in the slits 21. In so doing, the two locking ribs 210, 33 match each other and prevent the receiving head 3 from subsequently falling out of the base part. The length of the plug elements 30 is preferably such that they extend approximately as far as the lower edge of the base part 2 but do not protrude beyond the latter.

However, by pulling the receiving head and base part 2 slightly apart in the direction of their common longitudinal centre axis, the resistance of the locking ribs 210, 33 can be overcome, and these move past each other. If the plug elements 30 are designed to be slightly resilient, the release is made easier. Resiliency can be achieved, for example, through a suitable choice of the thickness of the plug elements 30, i.e. the material thickness. However, the two parts can only be separated from each other when they are not screwed onto the container 1.

The upper area of the receiving head 3 can be designed in any desired way. It preferably has supporting bodies or structures 34, 36 which are arranged peripherally and/or centrally and which interact with the suction body or teat 4 described below. In this example, a peripheral supporting structure 34 is formed by supporting wings 340 which are distributed uniformly about the circumference and arranged in the peripheral area. They protrude upwards and obliquely inwards like petals. In this example, they each have a substantially rectangular shape, their edges being rounded. These supporting wings 340 are preferably stiff. They can be made resilient, non-resilient or only very slightly resilient. In this embodiment, they are in particular produced in one piece with the rest of the receiving head in an injection moulding operation or in another suitable production method. However, the supporting wings 30 can also be made of a softer material than the plug elements 30. However, even though they are relatively soft, they are preferably dimensionally stable.

Underneath the supporting wings 340, i.e. in the transition area from the upper part to the lower part of the receiving head 3, a protruding circumferential securing edge 31 with a peripheral outer sealing surface 310 is present on the underside which is directed towards the base part 2 and the container 1. This sealing surface 310 is plane and extends approximately perpendicular to the longitudinal centre axis of the receiving head 3.

The teat 4 has a frustoconical main body 40 and a mouthpiece 42 formed integrally on the latter. The mouthpiece 42 has a tapered outer shape in comparison to the main body 40. The mouthpiece 42 is preferably designed in a known manner as a hollow cylinder, a hemisphere, a calotte or as a truncated cone. External and/or internal elevations, for example knobs or ribs, can be present, and also recesses, for example hollows or grooves. The inner and/or outer surface can be plane. It is possible, for example, to use axially extending ribs, radially extending ribs, obliquely extending ribs, or ribs that mesh in one another in the manner of a toothed wheel. The same applies to grooves. In the example shown here, an inner structure 44 in the form of ribs is present. The outer and/or inner surface of the main body 40 can also be plane or can be structured.

A suction opening 43 is present in the mouthpiece 42, preferably in the uppermost tip of the free end. In the assembled state, this suction opening 43 is connected to the interior of the container via the through-openings 32, 24 of the receiving head 3 and of the base part 2, such that the baby is able to take his or her drink, e.g. tea, water or milk, through this opening.

The main body 40 is curved inward with its lower edge, so as to provide a radially inwardly directed flange 41. The teat 4 can be pushed with its main body 40 over the supporting wings 340 of the receiving head 3, the upper part of the receiving head 3 being enclosed by the teat 4. The flange 41 engages behind the protruding edge between the upper and lower areas of the receiving head 3 and bears flat on the outer sealing surface 310 of the latter.

The teat 4 can thus be fitted onto the receiving head 3 and partially pushed over it. The receiving head 3 can then be plugged into the base part 2. The receiving head 3 can be plugged into the base part 2 when the latter is free, but also when it is already located on the container neck 11. Since the base part 2 can still be moved slightly in the axial direction relative to the receiving head 3, the teat 4 can also alternatively be pushed on over the receiving head 3 only when the latter and the base part 2 have been joined together.

By turning the base part 2 or the receiving head 3 on the container neck 11, the two threads, namely outer thread 12 and inner thread 301, engage in each other. The receiving head 3 runs downwards along the thread. Along with it, the base part is drawn down as far as its lower abutment. In the embodiments described here, this means that it bears with its upper inner bearing surface 29 on the upper edge of the container neck 11. The base part 2 and receiving head 3 are now secured on the container 1 and secured relative to each other in terms of rotation. In this way, the outer sealing surface 270 of the base part 2 is now pressed relative to the outer sealing surface 310 of the receiving head 3. They clamp the flange 41 of the teat 4 and thus ensure a liquid-tight and air-tight connection between teat 4, receiving head 3 and base part 2. Depending on the design, a differently shaped lower edge 41 of the teat 4 can also be clamped sealingly between the two parts 2, 3.

When the bottle 1 is no longer being used, the base part 2 can be rotated again such that the anti-rotation lock between base part 2 and receiving head 3 is also released. By virtue of the axial displaceability of the base part 2, the flange 41 is freed and the teat 4 can be removed from the receiving head 3. The plug connection between receiving head 3 and base part 2 can then be released. The three parts can now be cleaned as individual parts and, if appropriate, sterilized.

This embodiment has the advantage that it has a relatively simple design and is therefore easy to clean and inexpensive to produce.

Figure 2C:
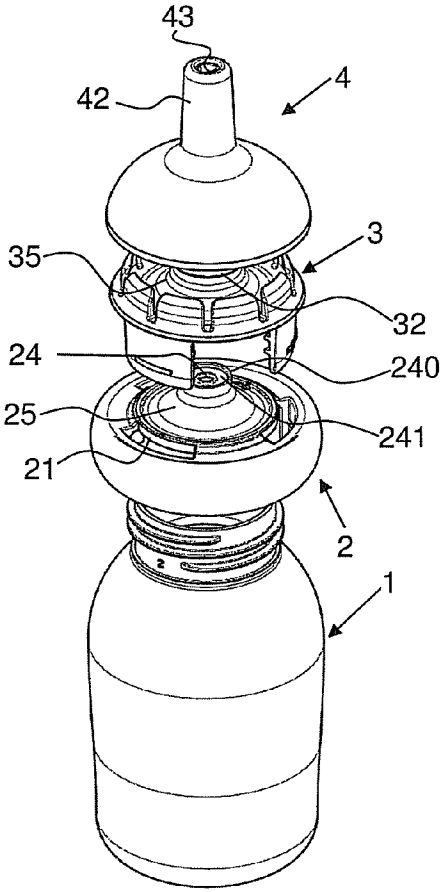
FIG. 2*c* shows a perspective view of the teat unit with breastmilk bottle according to FIG. 2*a;*
Figure 2B:
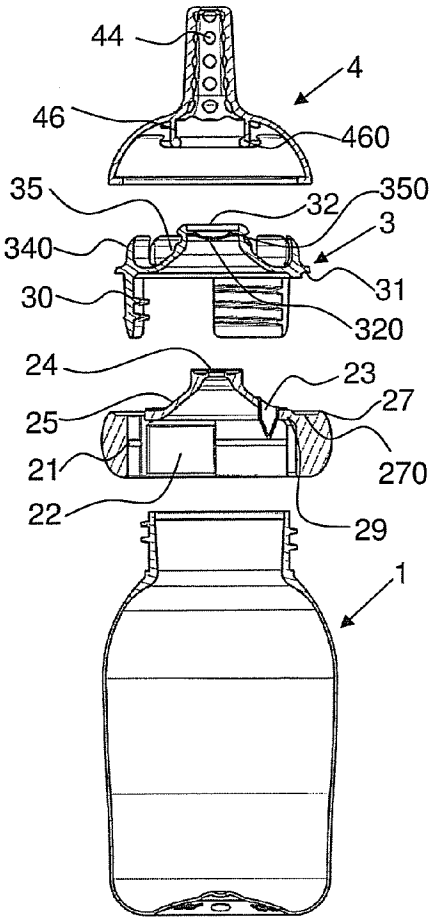
FIG. 2*b* shows a longitudinal section through the teat unit with breastmilk bottle according to FIG. 2*a;*
Figure 2A:
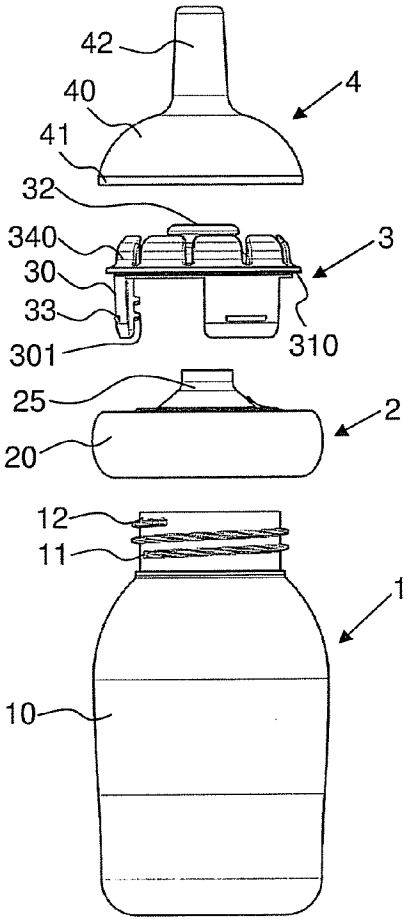
FIG. 2*a* shows an exploded side view of a teat unit according to the invention together with breastmilk bottle, according to a second embodiment.
Figure 3C:
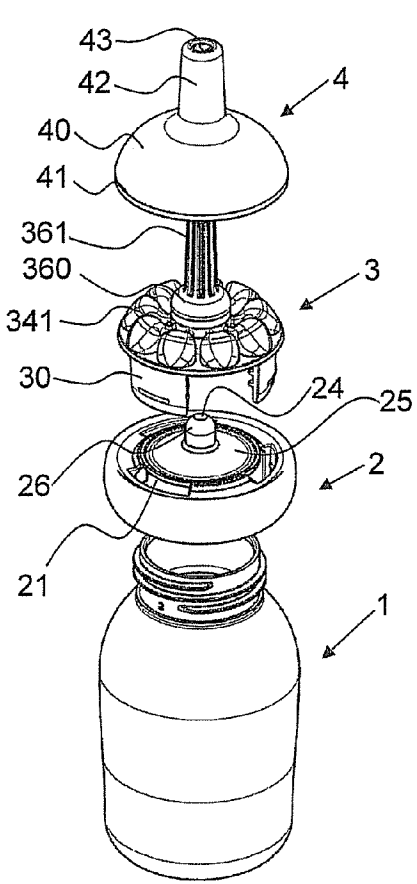
FIG. 3*c* shows a perspective view of the teat unit with breastmilk bottle according to FIG. 3*a;*
Figure 3B:
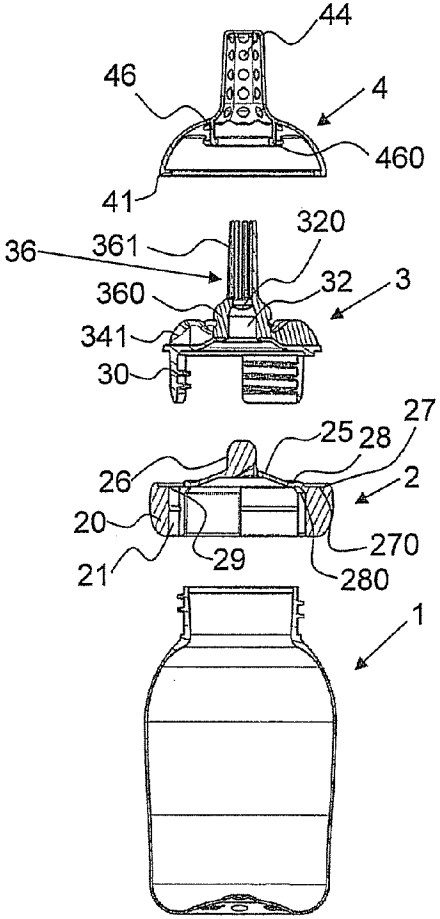
FIG. 3*b* shows a longitudinal section through the teat unit with breastmilk bottle according to FIG. 3*a;*
Figure 3A:
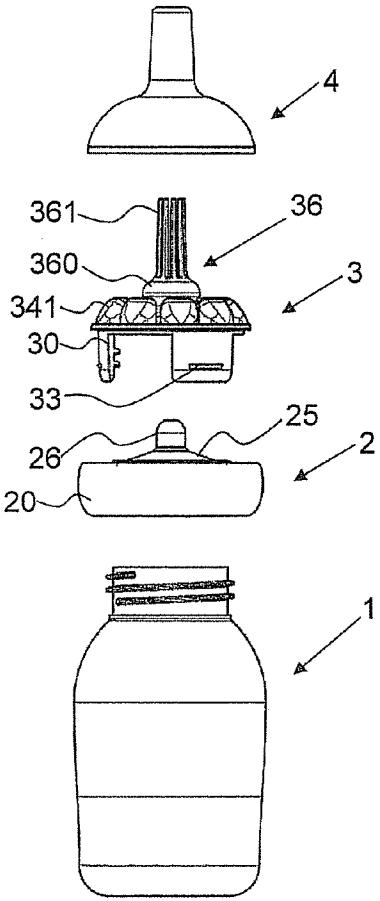
FIG. 3*a* shows an exploded side view of a teat unit according to the invention together with breastmilk bottle, according to a third embodiment.
Figure 3D:
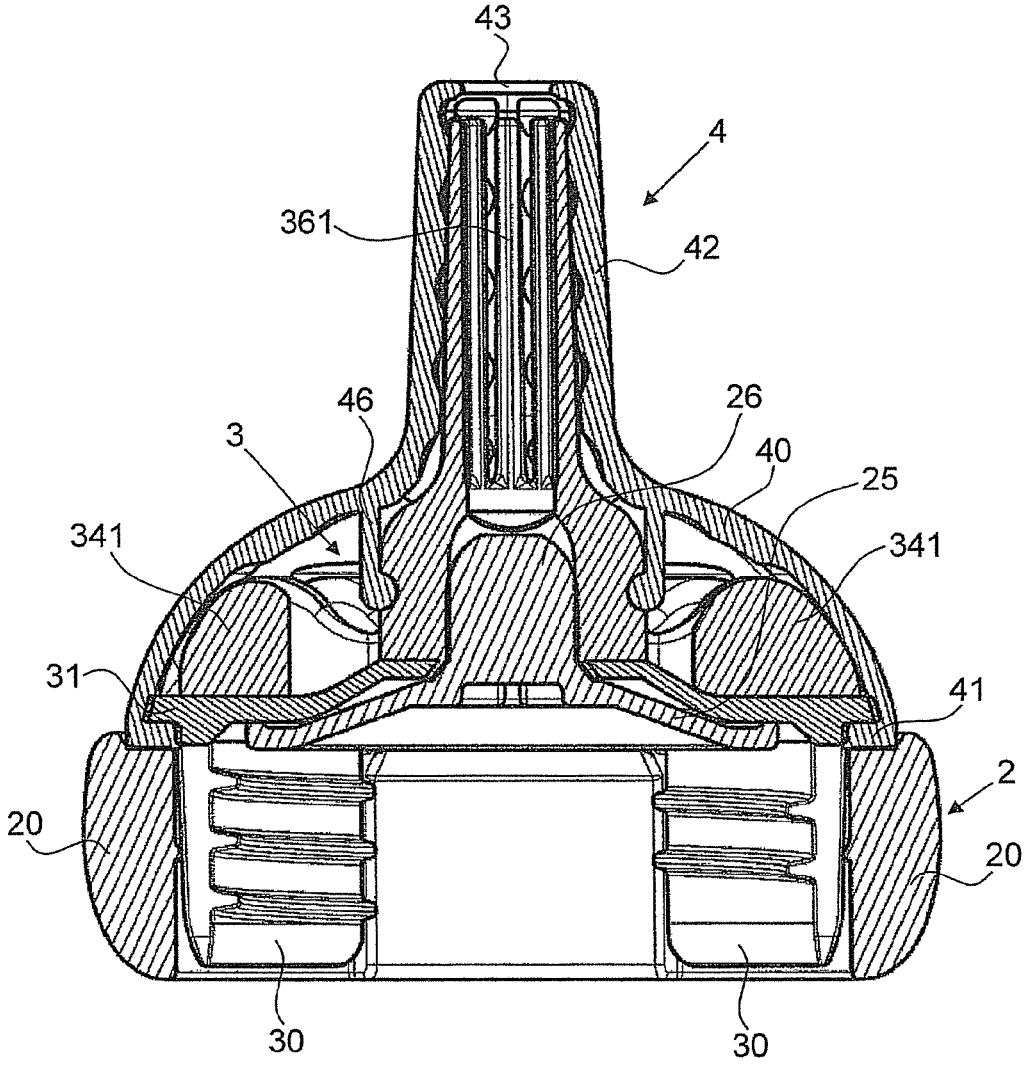
FIG. 3*d* shows a cross-sectional view of the teat unit of FIG. 3*a* in its assembled state.

A second embodiment of a teat unit is shown in FIGS. 2*a* to 2*c*. It is of a similar design to the one described above with reference to FIGS. 1*a* to 1*c*. Identical parts are therefore not mentioned or described in any more detail here. The same applies also to the embodiments described below.

In contrast to the first illustrative embodiment, the receiving head 3 and the base part 2 have through-openings 32, 24 with a smaller diameter. In the base part 2, an inner truncated cone 25 is integrally formed within the inner sealing edge 28 and in the upper area. Its flanks can be rectilinear or curved. It protrudes above the annular body 20 and extends upwards to the receiving head 3. The through-opening 24 is preferably arranged in the uppermost area, preferably in the flattened tip. This tip can have a cylindrical jacket and extend above the through-opening 24, such that it forms an upper sealing edge 240. A plane surface 241 is located in the interior of this sealing edge 240.

In the lower area of the inner truncated cone 25, and adjoining the inner sealing edge 28, a circumferential inner sealing surface 280 is present. It extends preferably perpendicular to the longitudinal centre axis of the base part 2.

Arranged in a flank of the inner truncated cone 25 there is a venting valve 23, here once again a duckbill valve, which protrudes axially inwards to the interior of the container.

In the interior, the receiving head 3 has an outer truncated cone 35 which protrudes upwards to the teat 4 and in the flattened tip of which the through-opening 32 is arranged. The uppermost area of the truncated cone 35 is surrounded by a bead, which delimits a circumferential groove 350.

A valve, in this case a diaphragm 320, is arranged in the interior of the tip of the outer truncated cone 35. It closes the through-opening 32.

The teat 4 has a skirt 46 that protrudes axially inwards and that ends, in the lower area, in a radially inwardly protruding flange 460 or a corresponding bead. The skirt 46 is arranged in the transition area between mouthpiece 42 and main body 40.

The mouthpiece 42 has inwardly directed knobs. However, as in the first example, it can have a plane surface or a differently configured surface structure.

If the teat 4 is now pushed on over the receiving head 3, it not only engages with its lower flange 41 around the upper area of the receiving head 3. The skirt 46 additionally surrounds the upper area of the outer truncated cone 35, its flange 460 engaging in the groove 350 and establishing a liquid-tight connection.

If the receiving head 3 is now plugged into the base part 2, the outer truncated cone 35 surrounds the inner truncated cone 25, and the two through-openings 24, 32 are preferably flush with each other in the longitudinal centre axis. The surface 241 forms the valve seat for the diaphragm 320. The venting valve 23 leads into a circumferential gap 5 between the two truncated cones 25, 35, which gap 5 is formed by the fact that the two truncated cones 25, 35 do not have the same inclination. This gap forms a vent chamber. At least one vent opening or relief opening 281 preferably leads outside from this chamber 5.

This second embodiment has a central supporting body protruding towards the mouthpiece 42, namely the outer truncated cone 35. In this way, the mouthpiece is optimally supported. Moreover, it can be provided with various valves. The presence of the valves is optional, not obligatory. Moreover, it is also possible for only one of these two valves to be used. Differently configured valves can also be used.

In the embodiment according to FIGS. 3*a* to 3*d*, the inner truncated cone 25 is situated in the inner area of the base part 2, but in this case it ends at the top in a cylindrical support teat 26. The through-opening 24 is arranged in the support teat 26. For example, it can be arranged at the top or on a side flank. Sealing edges and sealing surfaces are preferably also present as in the two examples already described, although not all are provided here with reference numbers.

Instead of the stiff supporting wings 340, the receiving head 3 has supporting cushions or blisters 341. These too are distributed uniformly about the circumference in the peripheral area and are oriented upwards. A central supporting structure 36 protrudes upwards in the middle. Its base is a hollow cushion, here a finger base 360. Elongate elements, here called lamellae or support fingers 361, protrude from it. Supporting cushion 38, finger base 360 and support fingers 361 are preferably made of a softer material than the plug elements 30 and the rest of the receiving head 3. They are preferably made of silicone, rubber or TPE. During production of the receiving head 3, they can be injection moulded onto its main body, by way of one example.

Like the flattened tip of the outer truncated cone 35 in the second illustrative embodiment, the finger base 360 can be provided with a groove for receiving the flange 460 of the skirt 46 of the teat 4. Moreover, a valve diaphragm 320 can be arranged in its interior, adjacent to the support fingers 361, the valve seat thereof being formed by the support teat 26 of the base part 2.

In the interior of its mouthpiece 41, the teat 4 has hollows or knobs 44. Other inner structures or a flat surface are also possible here.

In this illustrative embodiment, the interaction between receiving head 3 and teat 4 takes place all the way into the mouthpiece 41. Moreover, the softer and round supporting cushions 341 permit another sensation in or on the infant's mouth compared to the supporting wings 340 of the first two examples.

Figure 4C:
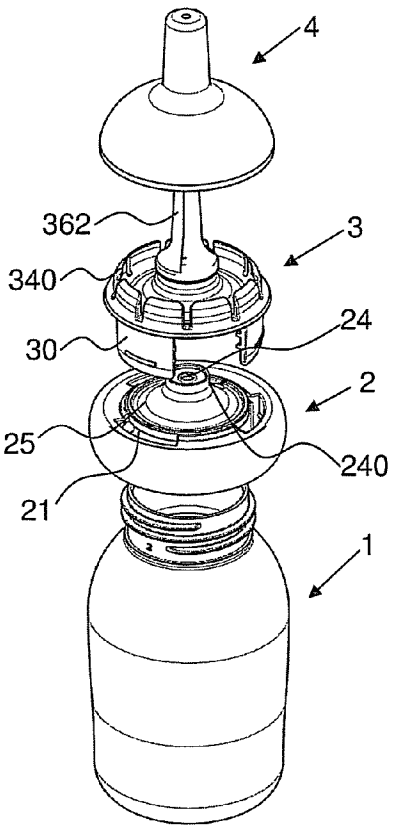
FIG. 4*c* shows a perspective view of the teat unit with breastmilk bottle according to FIG. 4*a;*
Figure 4B:
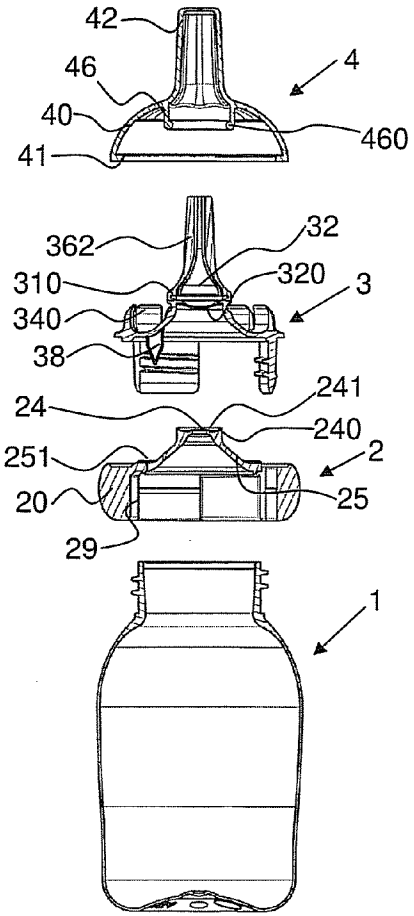
FIG. 4*b* shows a longitudinal section through the teat unit with breastmilk bottle according to FIG. 4*a;*
Figure 4A:
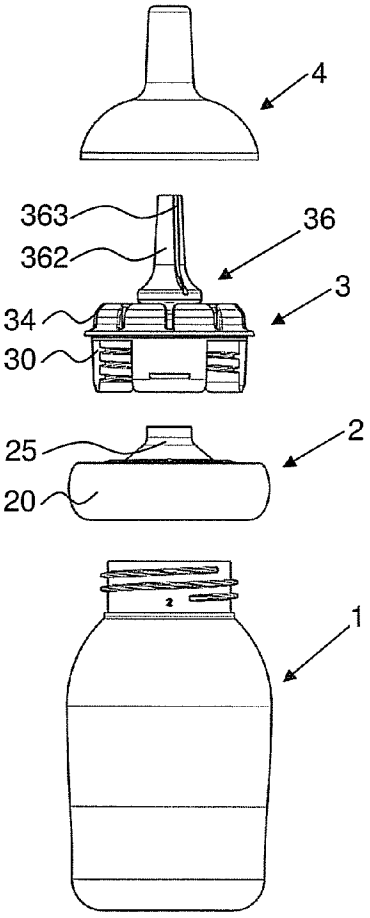
FIG. 4*a* shows an exploded side view of a teat unit according to the invention together with breastmilk bottle, according to a fourth embodiment.

FIGS. 4*a* to 4*c* show a fourth illustrative embodiment. The base part 2 corresponds to that of the second embodiment according to FIGS. 2*a* to 2*c*, but with no duckbill valve. However, in one flank of the inner, stiff truncated cone 25 there is an insert opening 251 through which a venting valve 38 can be pushed and is thus held in position. The venting valve 38 is in this case once again a non-return valve, for example a duckbill valve.

Here once again, the sealing edges and sealing surfaces described above, or similar ones, as in the preceding illustrative embodiments are present, although not all are designated by reference numbers.

The receiving head 3 once again has the stiff supporting wings 340. The outer and likewise stiff truncated cone 35 is arranged in the central area and merges into a central supporting structure 36, here with an upwardly protruding chimney-shaped inner support 362. This inner support 362 has a longitudinal slit 363 extending parallel to the longitudinal axis.

A valve diaphragm 320 is once again arranged in the inner support 362 below the longitudinal slit 363.

The inside of the mouthpiece 41 of the suction body 4 is free of structures and plane. The teat 4 comprises the skirt 46 and the flange 460.

When the teat 4 is pushed on over the receiving head 3, the skirt 46 bears sealingly with its flange 460 on the base of the inner support 362.

Figure 4D:
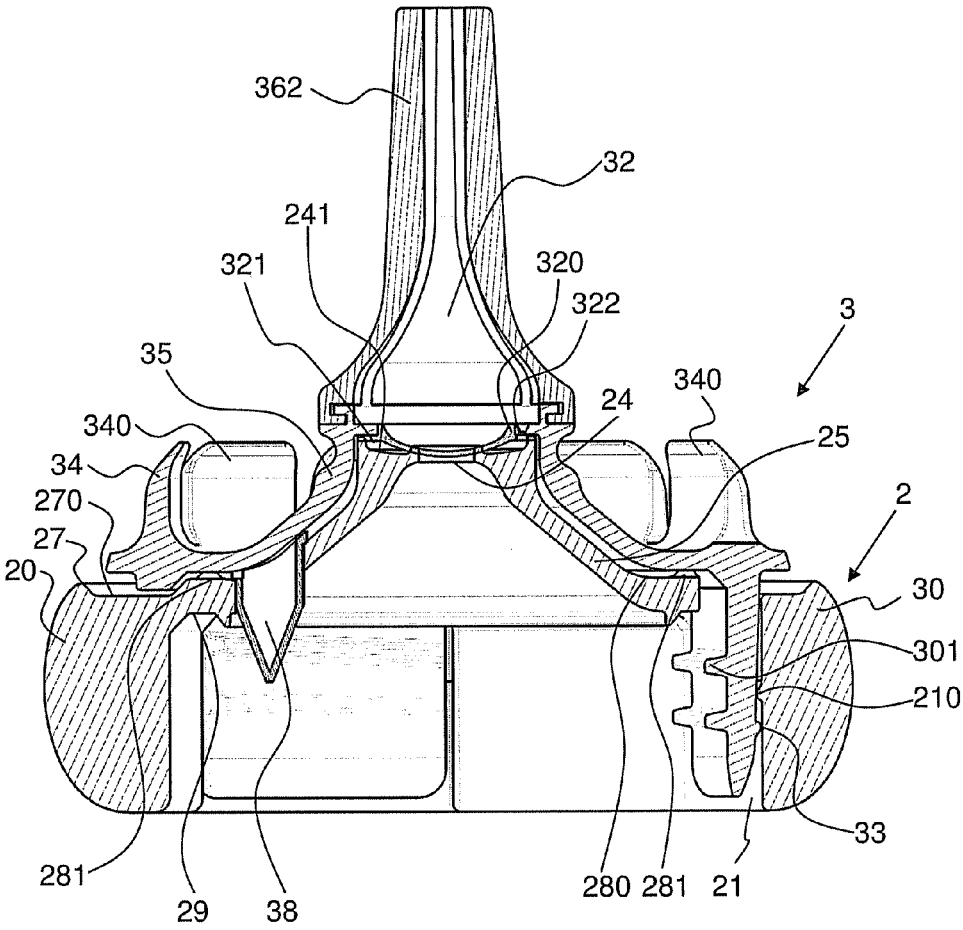
FIG. 4*d* shows an enlarged view of the teat unit according to FIG. 4*b* with the diaphragm valve closed.
Figure 4E:
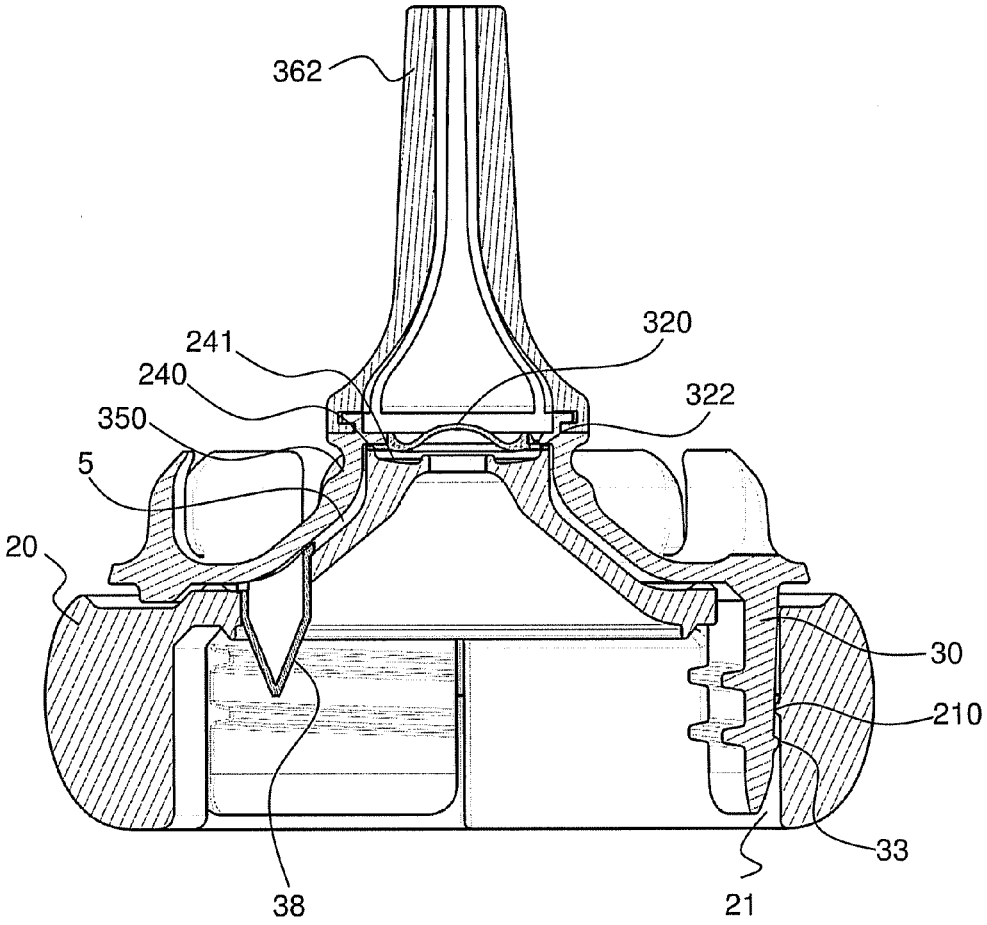
FIG. 4*e* shows an enlarged view of the teat unit according to FIG. 4*b* with the diaphragm valve opened.

FIGS. 4*d* and 4*e* now show how the diaphragm valve works. The diaphragm 320 of the valve bears with its flange 321 on an inner lower edge of the outer truncated cone 35. The diaphragm 321 is preferably clamped in the through-opening 32 of the receiving head 3. As is shown in FIG. 4*d*, it closes the through-opening 24 of the base part 2 and thus interrupts the flow of milk from the interior of the container to the suction opening 43.

In FIG. 4*e*, the diaphragm valve is open. This is the case when the baby is sucking on the mouthpiece. The milk or liquid can pass through the through-opening 24 and through one or more valve openings 322 in the diaphragm 320 into the inner support 362 and thereby into the mouthpiece 4 and to the suction opening 43.

FIGS. 4*d* and 4*e* also show the gap 5 between the two truncated cones 25, 35, which gap 5 is accessible via the venting valve 23, 38.

Figure 5C:
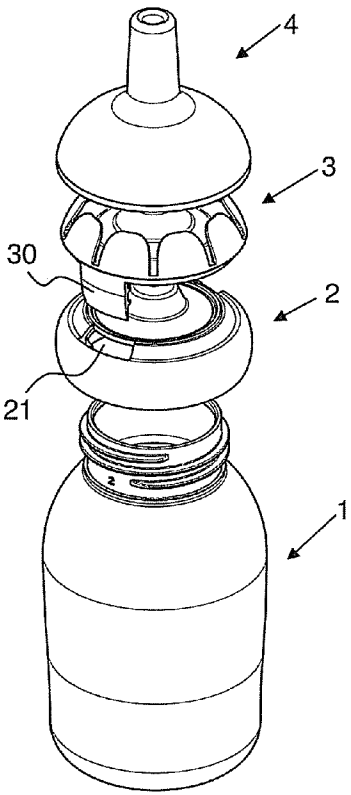
FIG. 5*c* shows a perspective view of the teat unit with breastmilk bottle according to FIG. 5*a;*
Figure 5B:
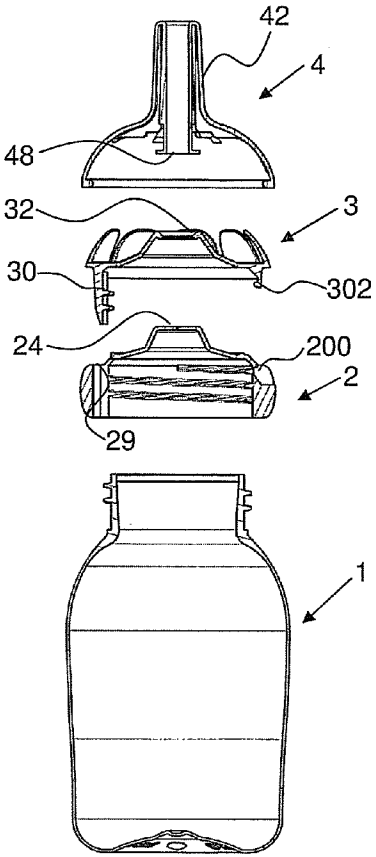
FIG. 5*b* shows a longitudinal section through the teat unit with breastmilk bottle according to FIG. 5*a;*
Figure 5A:
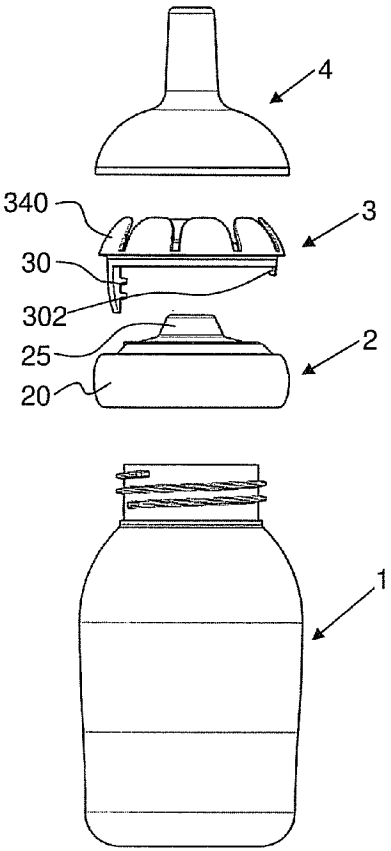
FIG. 5*a* shows an exploded side view of a teat unit according to the invention together with breastmilk bottle, according to a fifth embodiment.

FIGS. 5*a* to 5*c* show a fifth illustrative embodiment. Here, the receiving head 3 has a single plug element 30. Arranged on the diametrically opposite side there is a hinge 302, which engages in a corresponding cut-out 200 of the base part 2. A releasable plug connection is thus present, without the receiving head 3 and base part 2 having to be completely separated from each other. They can be cleaned together, but in the open position.

Figure 5D:
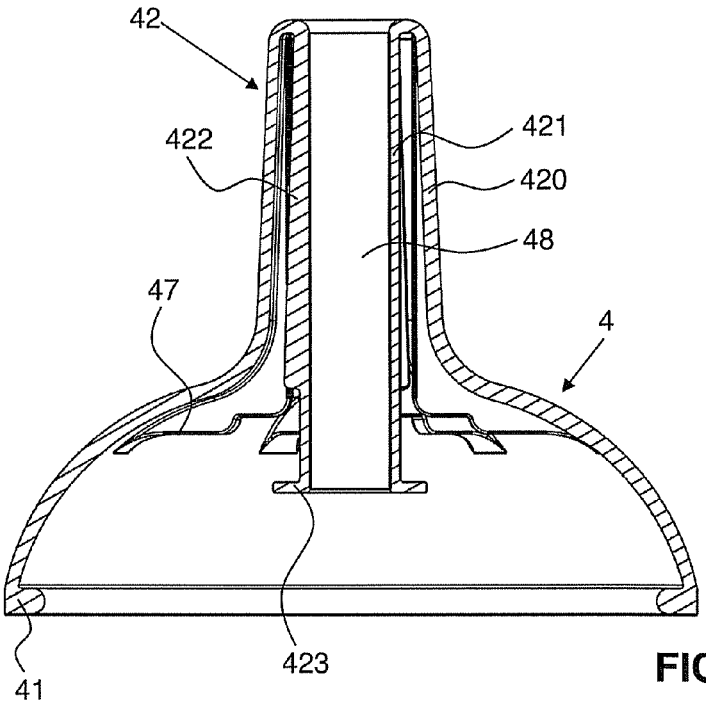
FIG. 5*d* shows a longitudinal section through a teat according to FIG. 5*a* in an enlarged view.
Figure 5E:
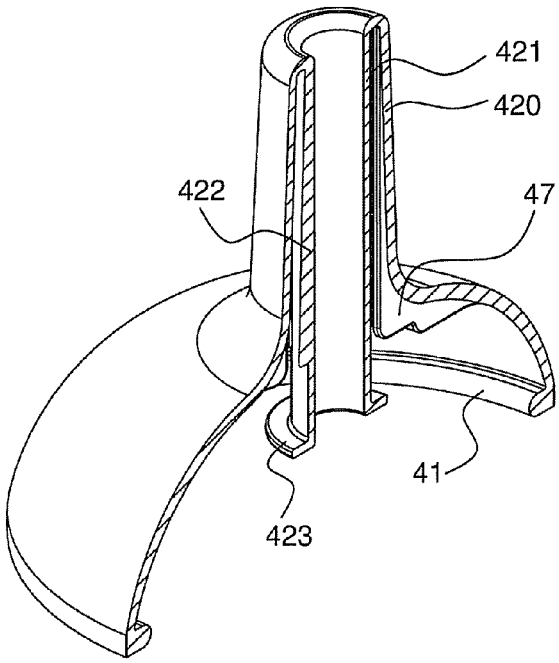
FIG. 5*e* shows a perspective view of the longitudinal section according to FIG. 5*d;*

The mouthpiece 42 of the teat 4 has a twin wall, as can be seen in particular from FIGS. 5*d* and 5*e*. It has an outer wall 420, an inner wall 421, and a flange 423 formed integrally on the lower end of the inner wall 421. Radially inwardly directed ribs 47 are preferably integrally formed on the outer wall 420. These strengthen the outer wall 420 and at the same time prevent the outer wall 420 from bearing completely on the inner wall 421 when there is a high underpressure (negative pressure). The inner wall 421 preferably also has ribs 422, which protrude radially outwards. They are preferably offset with respect to the ribs 47 at the circumference. Between teat 4 and receiving head 3, there is a support space 6, which deforms depending on the stress applied to the teat 4 by the infant.

Figure 5F:
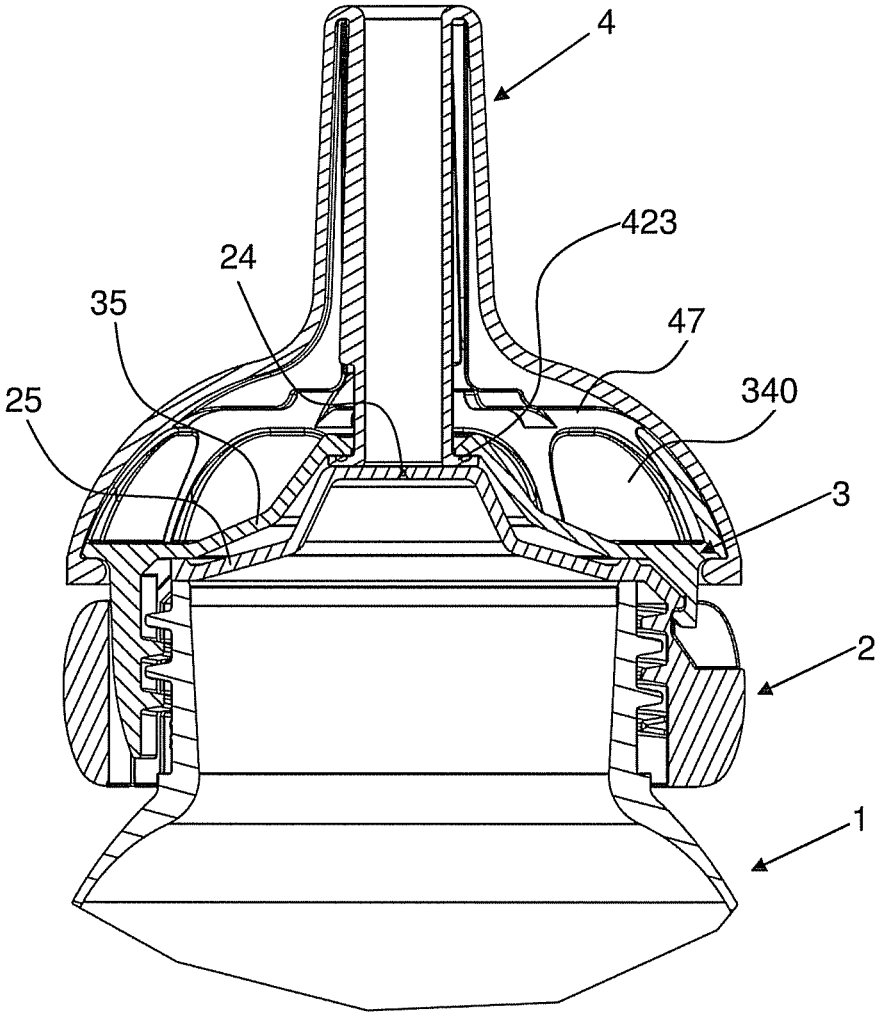
FIG. 5*f* shows a longitudinal section through the teat unit with breastmilk bottle according to FIG. 5*a*, in an enlarged view.
Figure 5G:
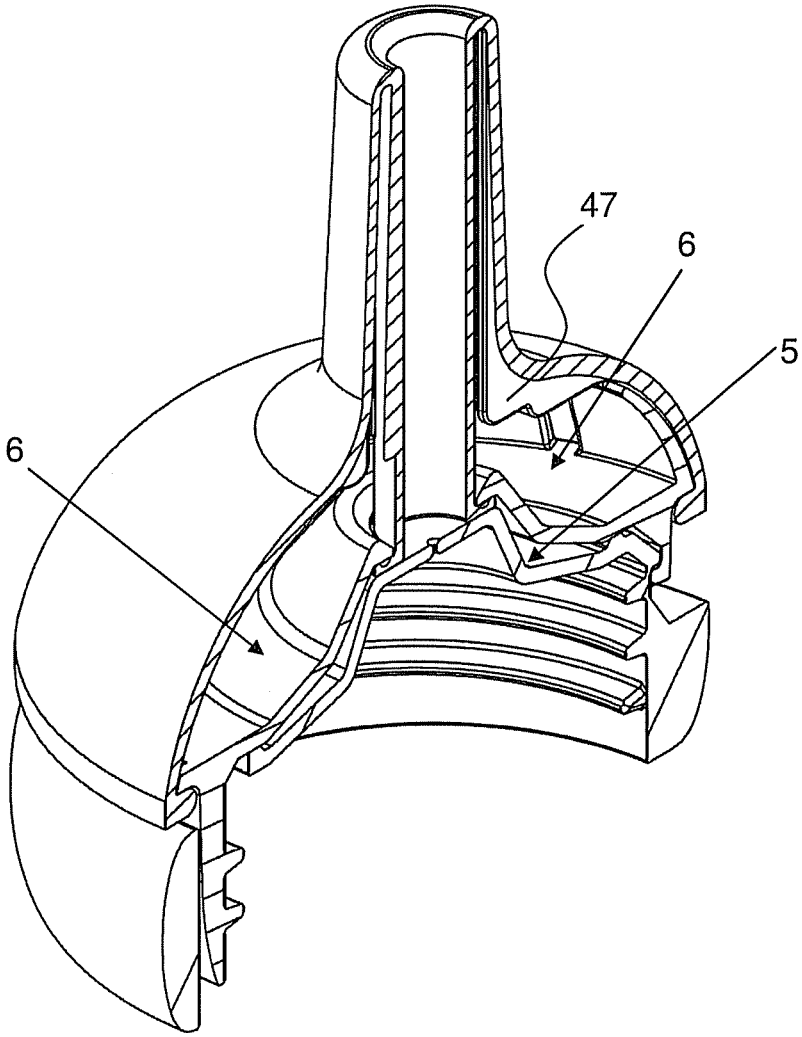
FIG. 5*g* shows a perspective view of the longitudinal section according to FIG. 5*f;*

The inner wall 421 preferably extends along the entire length of the mouthpiece 42 into the main body 40. It is preferably completely closed at its circumference and forms a central channel 48 through which the milk flows. The inner wall 421 ends in the flange 423, which protrudes radially outwards. This flange 423 can be hooked into the through-opening 32 of the receiving head 3 and forms a tight connection, as can be seen clearly in FIGS. 5*f* and 5*g*.

Figure 8:
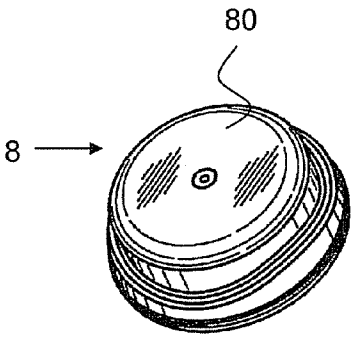
FIG. 8 shows a perspective view of a closure cap according to FIG. 7.
Figure 7:
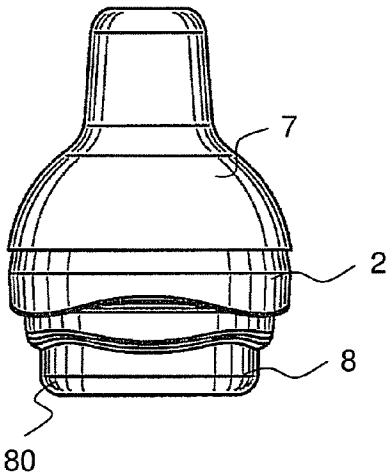
FIG. 7 shows a perspective view of a teat unit according to FIG. 6 with closure cap.
Figure 6:
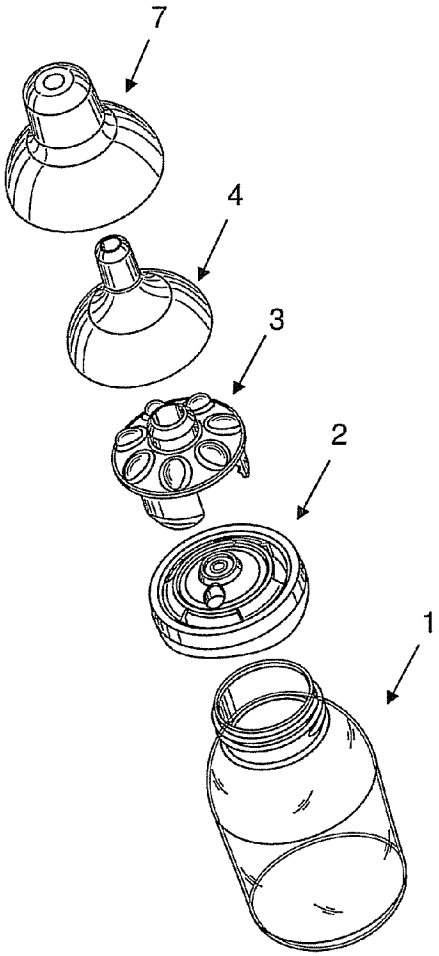
FIG. 6 shows an exploded view of a teat unit according to the invention with breastmilk bottle and lid.

The teat units described above are able to be provided with a lid and a closure cap. In FIG. 6, such a teat unit according to the invention is exemplary shown with lid 7. The lid 7 covers the teat 4 and encompasses the base part 2 in a form-fitting manner. This is shown in FIG. 7. FIG. 8 shows a closure cap 8 with a closed bottom 80 and a non-visible inner thread. The closure cap 8 is on the one hand able to be used as a closure cap for the baby's feeding bottle. On the other hand, it is able to be inserted into end of the base part 2 on the side of the bottle and to be plugged on the plug elements 30 of the receiving head 3. In this manner, the teat unit is closed from all sides. It is thus able to be stored and transported so as to be hygienically packaged.

As can be seen from the above examples, the base part, receiving head and teat can be formed in a wide variety of designs. Depending on their design, they can also be used in different combinations. The above examples cover only a small group of possible variations and combinations, which include inventive concepts of a modular three-part design, the releasable plug connection between receiving head and base part, and the securing to the container by means of the receiving head.

Moreover, the described supporting structures and teats shown in the figures can also be used jointly or separately from one another in teat units designed in accordance with the invention yet differently in view of the state of the art, while still within the spirit of the invention. In particular, they can also be used in teat units that have no separate base part and no receiving head to be plugged into the latter, and form part of the invention. Furthermore, also other teat units are able to be closed with the closure cap and the lid in order to be stored as a closed unit again forming part of the invention.

The invention claimed is:

1. A teat unit comprising:

a flexible teat, a receiving head, a dimensionally stable base part, and a venting valve, wherein the teat is arranged on the receiving head, wherein the receiving head and the base part are connected to each other by a releasable connection, wherein the venting valve is arranged in the base part, and wherein the teat comprises a circumferential edge, wherein the circumferential edge is clamped between the receiving head and the base part when fitted in the correct position of use on a drinks container.

2. The teat unit of claim 1 wherein the venting valve is held by the base part.

3. The teat unit of claim 1 wherein the base part comprises an inner truncated cone.

4. The teat unit of claim 3 wherein said inner truncated cone has rectilinear flanks.

5. The teat unit of claim 3 wherein said inner truncated cone has curved flanks.

6. The teat unit of claim 3 wherein the venting valve is arranged in said inner truncated cone.

7. The teat unit of claim 6 wherein the venting valve is held in said inner truncated cone.

8. The teat unit of claim 3 wherein the base part comprises an annular body and wherein the inner truncated cone extends to the receiving head.

9. The teat unit of claim 8 wherein the base part comprises a circumferential sealing edge and wherein the inner truncated cone is arranged within the circumferential sealing edge.

10. The teat unit of claim 8 wherein a through-opening is arranged in an uppermost area of the truncated cone.

11. The teat unit of claim 1 wherein the receiving head comprises an outer truncated cone.

12. The teat unit of claim 11 wherein the outer truncated cone comprises a flattened tip and wherein a through-opening is arranged in the flattened tip.

13. The teat unit of claim 11, wherein the base part comprises an inner truncated cone, and wherein the outer truncated cone surrounds the inner truncated cone.

14. The teat unit of claim 13 wherein a gap is formed between the inner truncated cone and the outer truncated cone, wherein the gap forms a vent chamber and wherein the venting valve communicates with the vent chamber.

15. The teat unit of claim 14 wherein the outer truncated cone has a first inclination and the inner truncated cone has a second inclination, wherein the first inclination and the second inclination are different from each other.

16. The teat unit of claim 1 wherein the receiving head comprises an underside directed to the base part and wherein said underside comprises a sealing surface.

17. The teat unit of claim 1 wherein the releasable connection is a plug connection allowing for the receiving head to be plugged into the base part.

18. The teat unit of claim 17 wherein the receiving head has a securing element for securing the teat unit on a drinks container.

19. The teat unit of claim 18 wherein the receiving head has at least one protruding plug element for the plug connection to the base part, and wherein the securing element is arranged on the at least one plug element.

20. The teat unit of claim 1, wherein the receiving head is designed in one piece and is dimensionally stable.

21. The teat unit of claim 1 wherein the teat is pushed over the receiving head, wherein the circumferential edge engages around a circumferential edge of the receiving head and bears on a circumferential sealing surface of the receiving head, wherein the base part has a circumferential sealing surface interacting with the circumferential sealing surface of the receiving head, and wherein the teat is clamped between the base part circumferential sealing surface and the receiving head circumferential sealing surface when fitted in the correct position of use on a drinks container.

22. The teat unit of claim 1 wherein the venting valve is a duck bill valve.

23. The teat unit of claim 1 wherein the receiving head and the base part have through openings for forming a channel between a suction opening in a mouthpiece of the flexible teat and a container, the channel conducting a liquid from the container to the suction opening.

24. The teat unit of claim 23 wherein the venting valve is arranged in one of the through openings.

25. The teat unit of claim 24 wherein the venting valve is arranged in the through opening of the base part and is fixed to the base part.

* * * * *